US006651350B1

(12) United States Patent
Manns et al.

(10) Patent No.: US 6,651,350 B1
(45) Date of Patent: Nov. 25, 2003

(54) ORBITING SIGHT ESPECIALLY FOR ARCHERY

(76) Inventors: Marvin L. Manns, 8714 Duquette Rd., Yale, MI (US) 48097; Wayne A. Manns, 8472 Todd Rd., Yale, MI (US) 48097; Patrick A. Manns, 2961 Wellman Line Rd., Yale, MI (US) 48097

( * ) Notice: Subject to any disclaimer, the term of this patent is extended or adjusted under 35 U.S.C. 154(b) by 0 days.

(21) Appl. No.: 10/061,694

(22) Filed: Feb. 1, 2002

Related U.S. Application Data

(60) Provisional application No. 60/301,883, filed on Jun. 29, 2001.

(51) Int. Cl.[7] ..... F41G 1/00; F41B 5/00

(52) U.S. Cl. ..... 33/265; 33/263; 124/87

(58) Field of Search ..... 33/263, 265; 124/87

(56) References Cited

U.S. PATENT DOCUMENTS

| | | | | | |
|---|---|---|---|---|---|
| ,036,730 | A | | 10/1862 | Allen | |
| 2,534,946 | A | | 12/1950 | Bradley | |
| 2,669,023 | A | * | 2/1954 | Pizzuti | 33/265 |
| 2,925,656 | A | | 2/1960 | Genovese | |
| 3,182,400 | A | | 5/1965 | Nyc | |
| 3,521,362 | A | * | 7/1970 | Duplechin | 33/265 |
| 3,922,795 | A | * | 12/1975 | Bettencourt | 33/265 |
| 4,120,096 | A | | 10/1978 | Keller | |
| 4,473,959 | A | | 10/1984 | Saltzman | |
| 4,532,717 | A | | 8/1985 | Watson et al. | |
| 4,561,204 | A | * | 12/1985 | Binion | 42/122 |
| 4,580,349 | A | * | 4/1986 | Webb et al. | 33/265 |
| 4,584,777 | A | * | 4/1986 | Saunders | 33/265 |
| 4,860,458 | A | * | 8/1989 | Ernstsen | 33/265 |
| 4,884,347 | A | * | 12/1989 | Larson | 33/265 |
| 4,887,582 | A | | 12/1989 | Chattin | |
| 4,974,328 | A | * | 12/1990 | Lowry | 33/265 |
| D317,574 | S | | 6/1991 | Chen | |
| 5,305,530 | A | * | 4/1994 | Robertson, Jr. et al. | 33/265 |
| 5,442,861 | A | | 8/1995 | Lorocco | |
| D362,708 | S | | 9/1995 | Brown | |
| 5,450,909 | A | | 9/1995 | Stevenson | |
| 5,511,317 | A | * | 4/1996 | Allen | 33/265 |
| 5,539,989 | A | | 7/1996 | Potter | |
| 5,630,279 | A | | 5/1997 | Slates | |

(List continued on next page.)

FOREIGN PATENT DOCUMENTS

DE 32 43 956 A1 5/1984

OTHER PUBLICATIONS

Manns et al., U.S. provisional patent application No. 60/301,883 filed on Jun. 29, 2001.

(List continued on next page.)

*Primary Examiner*—Christopher W. Fulton
*Assistant Examiner*—Yartiza Guadalupe
(74) *Attorney, Agent, or Firm*—Christopher John Rudy

(57) ABSTRACT

Orbiting sight includes a pivotable sight-mounting member; and, attached in a pivoting relationship to said member, a sighting unit. The sighting unit can remain positioned in a fixed orientation in relation to an axis. The orbiting sight can be attached to a projectile-type weapon, especially, an archery bow. Provided also, in a projectile-type weapon other than an archery bow, the improvement of an orbiting sight including a pivotable sight-mounting member, which heed not necessarily be, but advantageously is, such that it remain positioned in a fixed orientation to an axis; and, attached to it, a sighting unit.

19 Claims, 5 Drawing Sheets

U.S. PATENT DOCUMENTS

| | | | | | |
|---|---|---|---|---|---|
| 5,644,849 | A | | 7/1997 | Slates | |
| 5,651,185 | A | * | 7/1997 | Vanderheyden et al. | 33/265 |
| 5,718,215 | A | | 2/1998 | Kenny et al. | |
| 5,762,059 | A | * | 6/1998 | Strope | 124/87 |
| 5,920,996 | A | * | 7/1999 | Hurckman et al. | 33/265 |
| RE36,266 | E | | 8/1999 | Gibbs | |
| 6,073,351 | A | * | 6/2000 | Barnett | 42/136 |
| 6,079,111 | A | | 6/2000 | Williams et al. | |
| 6,145,208 | A | | 11/2000 | Savage | |
| 6,430,821 | B1 | * | 8/2002 | Cionni | 33/265 |

OTHER PUBLICATIONS

Johnny Morris Bass Pro Shops, Archery Specialists Catalog 2001, cover, inside, and pp. 35–40.

Truglo, www.truglo.com, Pro–series Magnum Range Rover fiber optic sight, retrieved Jan. 29, 2002.

Truglo, www.truglo.com, Range Rover bow sight, retrieved Jan. 29, 2002.

Truglo. www.truglo, com, Pro–dot target pin, retrieved Jan. 29, 2002.

Truglo, www.truglo.com, Rite Site/Glo–brite pin assembly, retrieved Jan. 29, 2002.

Truglo, www.truglo.com, Rite Site, retrieved Jan. 29, 2002.

Truglo, When Brightness Counts, 2002 catalog, front, rear covers, p. 8 (Archery Pins).

* cited by examiner

FIG. 1
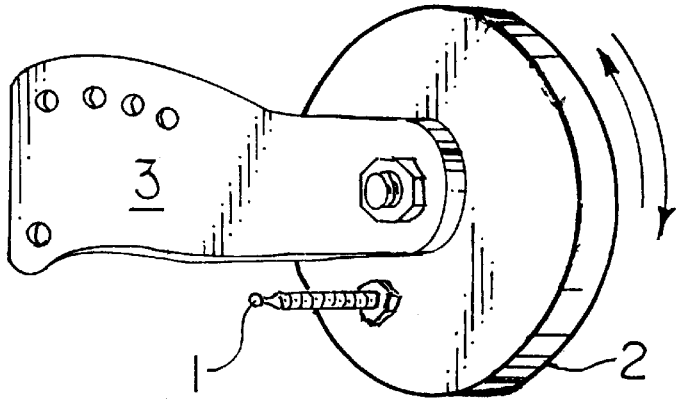
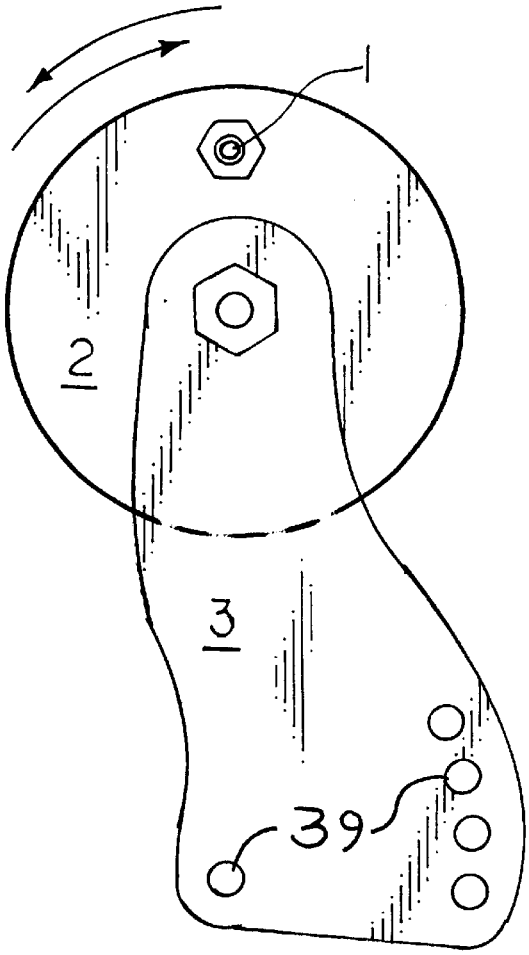
FIG. 2
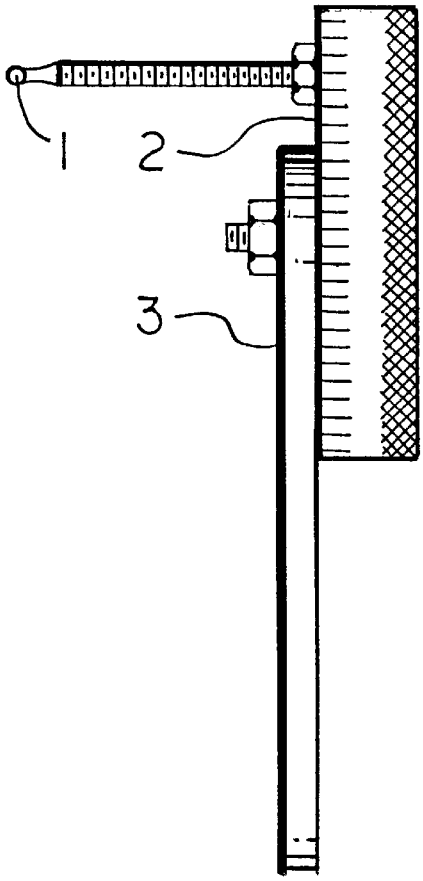
FIG. 3

ORBITING SIGHT ESPECIALLY FOR ARCHERY

CROSS-REFERENCE

This claims 35 USC 119(e) benefit of provisional application No. 60/301,883 filed on Jun. 29, 2001 A.D. The specification of that application is incorporated herein by reference.

FIELD AND PURVIEW

The present invention concerns a sight, which is adjustable for sighting in targets at various distances through elevation of a sighting unit by rotation about a pivot. The sighting unit may remain positioned in a fixed orientation with respect to an axis. The sight is useful in aiming in weaponry, especially archery.

BACKGROUND

In the field of archery, numerous bow sights are known. See, e.g., Archery Specialists Catalog 2001, Johnny Morris Bass Pro Shops, Springfield, Mo., pages 36–40. See also, Lorocco, U.S. pat. No. 5,442,861, which is incorporated herein by reference.

Recently, a simple orbiting pin sight for archery bows was developed by Patrick A. Manns of Yale, Mich. See, present FIGS. 1–3. That sight, essentially without more, is adjustable for sighting in targets at various distances through elevation of a pin 1 set on a simple rotating disc 2 that is attached to an arm 3 for attachment in a conventional manner to the bow frame.

Other projectile-type weapons such as crossbows, grenade launchers, and shot-or bullet-launching firearms, can involve sighting targets of various distances. Sights generally adjust for elevation through vertical movement of a sight elevator.

It would be desirable to improve upon the foregoing.

SUMMARY

The present invention provides an orbiting sight comprising a pivotable sight-mounting member; and, attached in a pivoting relationship to said member, a sighting unit, the attachment being such that the sighting unit can remain positioned in a fixed orientation in relation to an axis. Provided as well, in a projectile-type weapon other than an archery bow, the improvement comprises an orbiting sight comprising a pivotable sight-mounting member; and, attached to said member, a sighting unit. The orbiting sight can be attached to weaponry such as a crossbow, grenade launcher, shotgun, rifle, or handgun, but preferably to a hand-held archery bow, most especially when the sighting unit of the orbiting sight is a unit which can remain positioned in a fixed orientation in relation to an axis.

The invention is useful in target acquisition in weaponry. Significantly by the invention target acquisition is improved dramatically. In particular, scope-type sighting units can be employed in archery and be easily adjusted for targets of various distances. Numerous further advantages attend the invention.

DRAWINGS

The drawings form part of the specification hereof. With respect to the drawings, which are not necessarily drawn to scale, the following is briefly noted:

FIG. 1 is a perspective view of an orbiting sight with a simple, non-pivotable sighting unit.

FIG. 2 is a side view of the sight of FIG. 1.

FIG. 3 is a top view of the sight of FIGS. 1 & 2.

ILLUSTRATIVE DETAIL

The invention can be further understood by the present detail, which may be read in view of the drawings. Such is to be taken in an illustrative, and not necessarily limiting, sense.

In general, an orbiting sight includes a pivotable sight-mounting member. Attached to the sight-mounting member is a sighting unit, which, beneficially, is attached in a pivoting relationship to the sight-mounting member such that the sighting unit can remain positioned in a fixed orientation in relation to an axis. In the practice of the present invention, either the simple or the further pivoting orbiting sight can be attached and employed with a projectile-type weapon to include those having a frame with a significant horizontal component thereto, for instance, a weapon with a shoulder stock such as a crossbow, grenade launcher, shotgun, or rifle; as well a handgun. However, and preferably, the orbiting sight is of the pivoting variety, having a sighting unit which can remain positioned in a fixed orientation in relation to an axis. The latter sight, beneficially, can be attached in a conventional manner, say, to an archery bow such as a hand-held, traditional bow, longbow, recurve bow, or a compound bow.

The orbiting sight may be made with any suitable materials to include metal, plastic, glass and/or wood. Any suitable dimensions to its parts may be employed.

Figure 4:
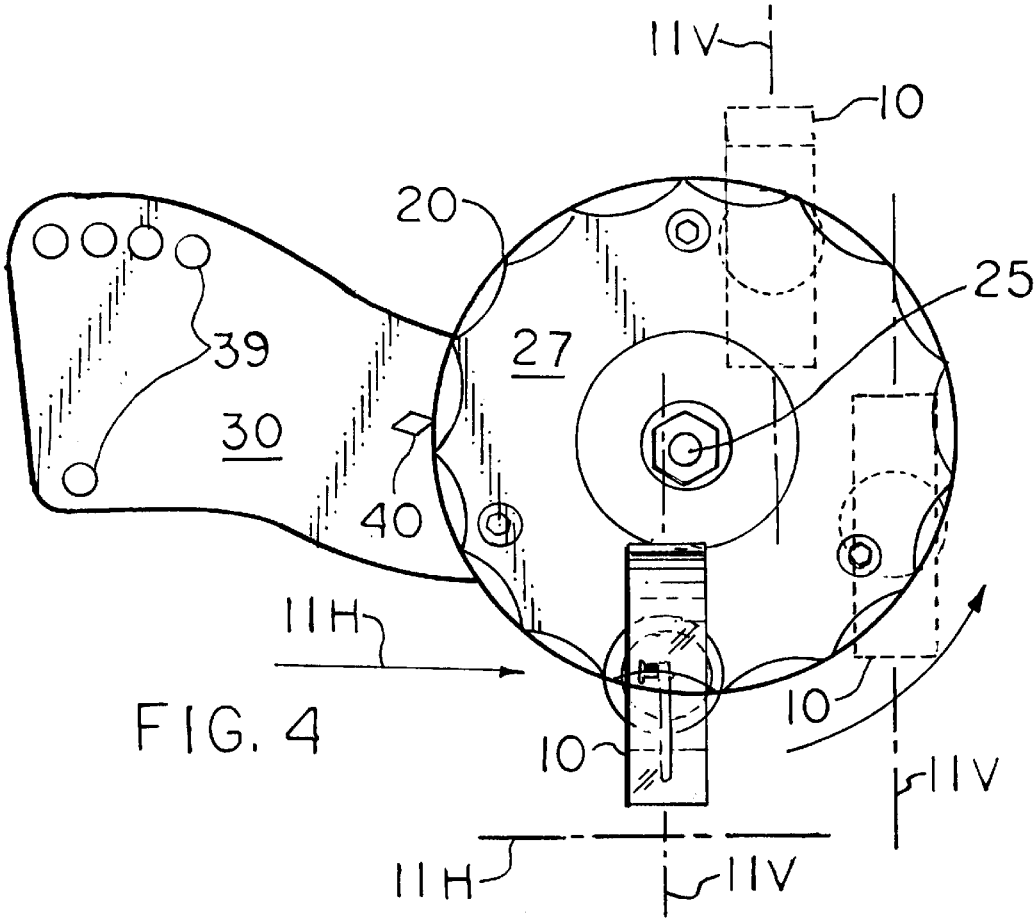
FIG. 4 is a side plan view of an orbiting sight with a sighting unit that can pivot and remain positioned in a fixed orientation in relation to an axis.
Figure 5:
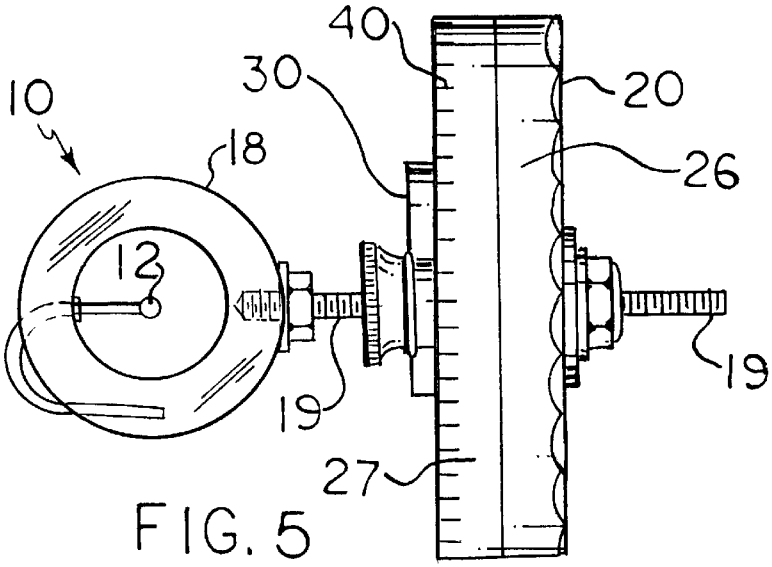
FIG. 5 is a front view of the sight of FIG. 4.
Figure 6:
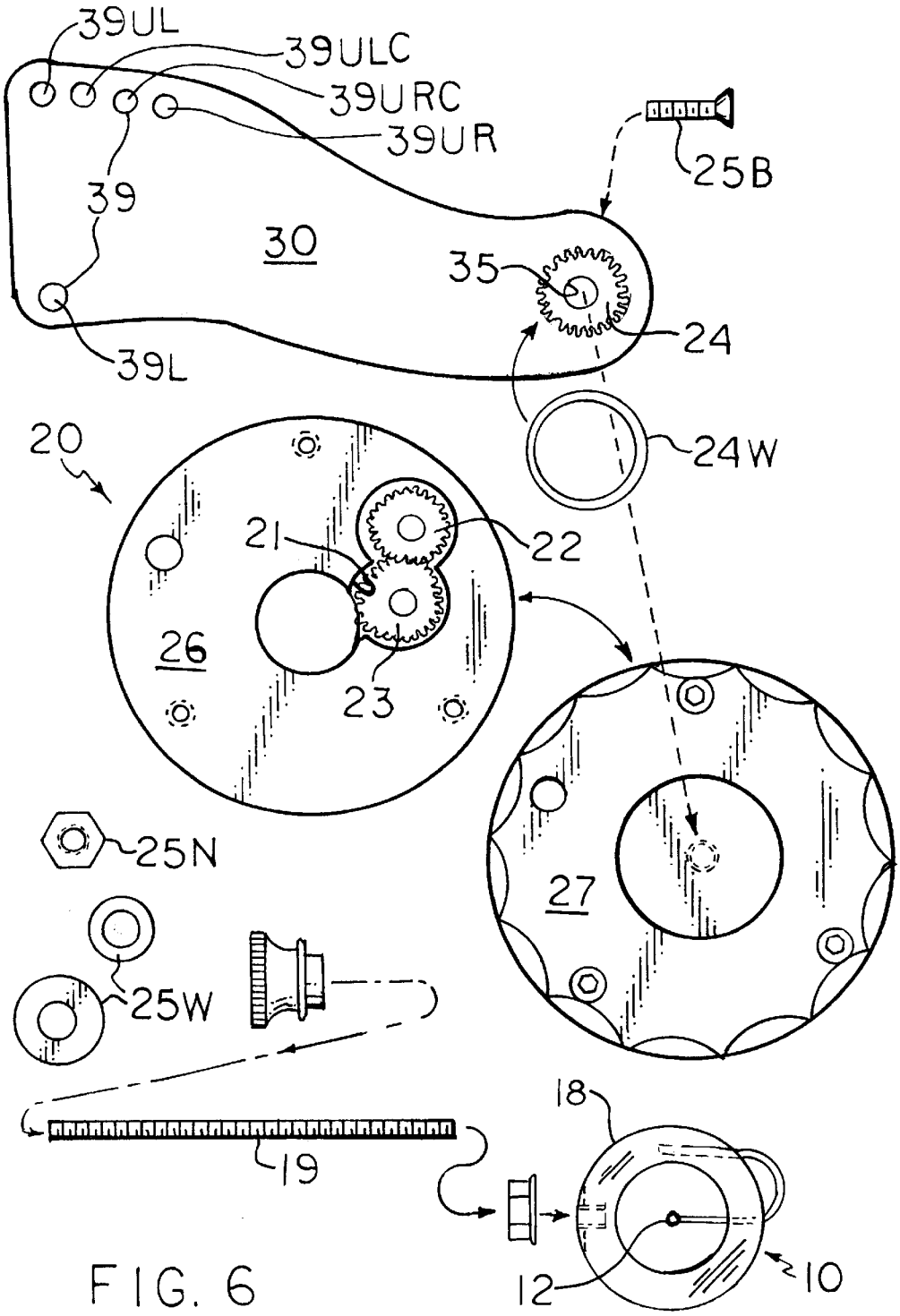
FIG. 6 is an exploded view of the sight of FIGS. 4 & 5.
Figure 7:
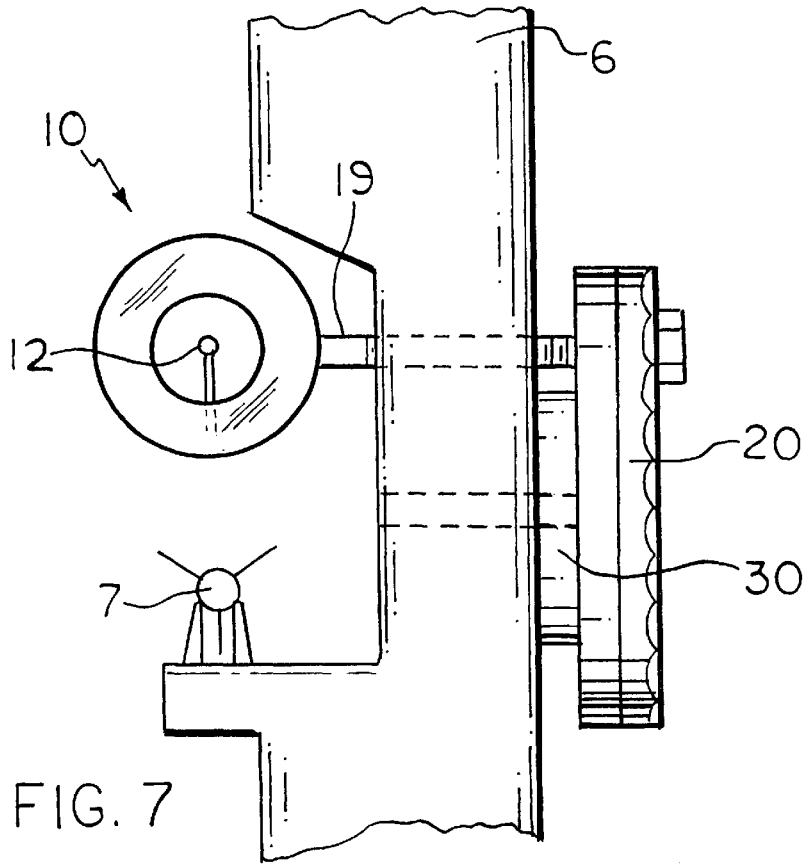
FIG. 7 shows an orbiting sight mounted on an archery bow.
Figure 8:
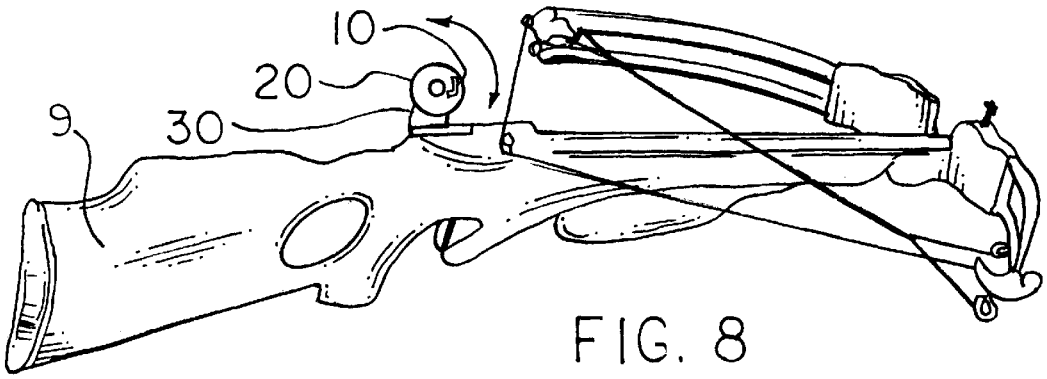
FIG. 8 shows an orbiting sight mounted on a crossbow.
Figure 9:
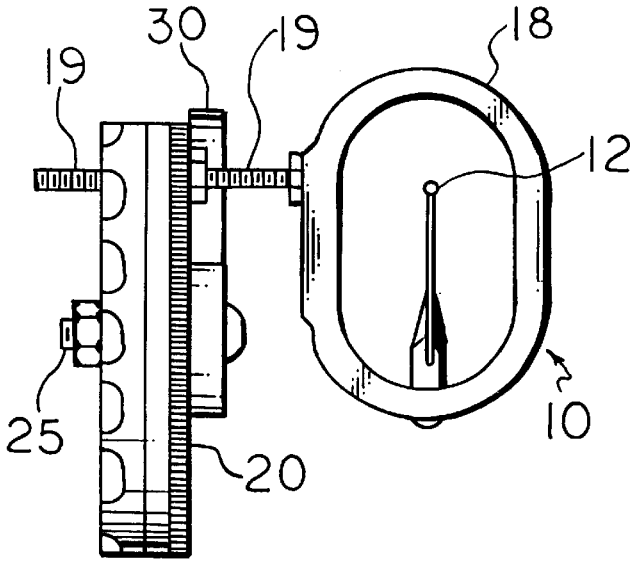
FIG. 9 is a front view of another embodiment of an orbiting sight with a sighting unit that can pivot and remain positioned in a fixed orientation in relation to an axis.
Figure 10:
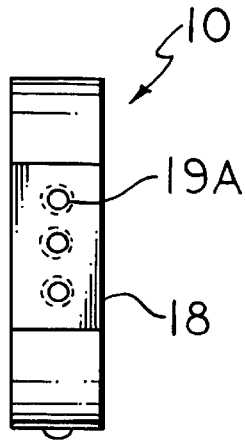
FIG. 10 is a left hand side view of the generally ovoid sighting unit seen within the orbiting sighting unit of FIG. 9.
Figure 11:
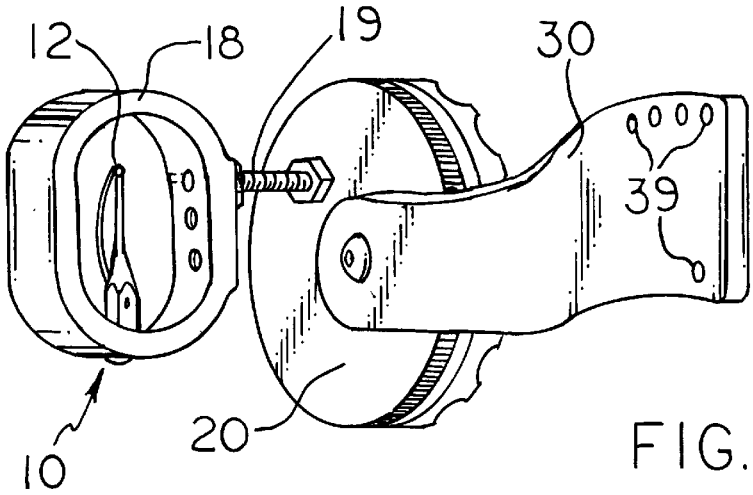
FIG. 11 is a rear perspective view of the orbiting sighting unit of FIG. 9.

With reference to the drawings, FIGS. 1–3 depict a simple, orbiting sight. FIGS. 3–6 and 9–11 depict orbiting sights having a pivoting sighting unit that can remain positioned in a fixed orientation in relation to an axis. FIGS. 7 & 8 depict an orbiting sight mounted on an archery bow, looking downrange, and a crossbow, respectively. The simple sight (FIGS. 1–3) can be mounted in place of the orbiting, pivoting sight (FIGS. 4–11) in the practice of the invention in weapons other than archery bows.

As noted previously, the simple orbiting sight includes sight pin 1 set on simple rotating disc 2 attached to mounting arm 3. Further, the pin 1 may have a light-enhancing point of reference on its tip such as provided by a light-gathering element or fluorescent paint. The disc 2 and arm 3 may be made of a metal or alloy to include aluminum, brass and/or steel, to include stainless steel, or include or be made of a suitable plastic or wood. Fasteners such as rivets, nails, pegs, rods, studs, bolts, screws, nuts, and so forth, may be employed and be of any suitable material; gluing and/or heat-sealing may be employed as may be appropriate.

The orbiting sight having a further pivoting sighting unit may be mounted on a bow having riser 6, which shoots arrow 7, as shown in FIG. 7, or on other weapon, say, a crossbow, having shoulder stock 9, as shown in FIG. 8, and includes sight unit 10 pivotally attached to remote from the pivot point of pivotable sight-mounting member 20, which is rotatably attached to mounting arm 30. The sight unit 10 can pivot to remain positioned perpendicularly with respect to horizontal target axis 11H, i.e., parallel with vertical axis 11V. The sight unit 10 beneficially is of the well-known scope type, for example, as disclosed in the aforementioned patent to Lorocco, for example, in its FIG. 20. Many such scope type sights are commercially available, and may be employed herewith. Compare, present FIGS. 4–7. However, the sight unit 10 is more advantageously, in general, an ovoid type scope sight unit with an elongate sighting pin oriented along the major axis of the ovoid. See, e.g., present FIGS. 9–11. The scope type sight may include light-gathering fiber pin 12 mounted within tubular body 18, say, made of a light-transmissive plastic or other suitable material, beneficially, for example, type-6061 aluminum, such as found in the ovoid type scope, which is secured to a lateral mounting post 19, say, through mounting post hole 19A. The mounting post 19, which may be of any suitable material such as a suitable metal to include brass, aluminum or steel, advantageously, for example, a stainless steel rod, typically is threaded, say, with a 10–32 thread arrangement, and secured by one or more nuts, say, of brass, or other suitable metal or plastic, with washers being employed as may be desirable. The elongate sighting pin may be a light gathering fiber pin 12 such as commercially available, say, from TRUGLO (Reg. U.S. Pat. & Tm. Off.) Inc., for example, a PRO-DOT FIBER OPTIC SIGHT PIN model #TG842G (green). Compare, the incorporated patent to Lorocco. Red, yellow, or any other suitable color fiber optic sight, or enhanced, phosphorescent-type fiber optic sight, may be employed as desired. As one of many other alternatives, the sight unit 10 may be a simple pin-type sight, for example, one with an L-shaped pin sight, which, for instance, may be equipped to gather light and display it as an aiming point also. See, e.g., Lorocco, for example, FIGS. 1, 6 & 20. Note, present FIG. 8.

The sight unit 10 can be attached in a pivoting relationship to the pivotable member 20, represented as being a rotating disc housing having hollow gear-receiving chambers 21, through the post 19 being affixed to sight-mounting outside gear 22 mounted in the chamber 21. The gear 22 is in mechanical communication through its teeth with middle gear 23 through its teeth, which is in mechanical communication through its teeth with central gear 24 through its teeth. Washer 24W may be present. The gears 22, 23, 24 may be of any suitable style, say, each being of the planetary style and each with twenty-four teeth, and be of any suitable material, say, nylon or brass, steel, stainless steel, and so forth. Advantageously, the gears are of planetary, made of type-1215 steel, each with twenty teeth, a 20-degree pressure angle, and a 32-pitch. Gears may be lubricated. Teeth may be substituted for with friction-type and/or magnetic materials. The central gear 24, which may be mounted directly to the arm 30 as by a press fitting or through threading to pivot post 25, and thus be a stationary gear, is mounted to be positioned in the center of the rotating disc housing 20 when the pivoting orbiting sight is assembled. Affixed to the central gear 24 is the pivot post 25, which is mounted by being passed through the arm 30, which, say, is of aluminum. Pivot post nut 25N and washer(s) 25W may be present. For convenience in manufacturing and in assembly, the disc housing 20, made, say, of type-6061 aluminum, may come in two parts, inner disc 26 and outer disc 27. The pivot post 25 may pass through forward mounting hole 35. Rear weapon-mounting holes 39, as with the simple orbiting sight, may be present. In conjunction with a lower mounting hole 39L, a series of upper sight mounting holes 39UL (upper left); 39ULC (upper left center); 39URC (upper right center); as well as 39UR (upper right) may be provided. In archery applications, for example, with the arm 30 pinned through the lower hole 39L to the riser 6 of the bow and the sighting unit 10 at the uppermost position on the disc 20, the archer selects the one of the upper holes 39UL, 39ULC, 39URC, 39UR which provides for a convenient close-in target acquisition setting, say, twenty yards, and uses that hole for mounting also. Then, the longer target distances are sighted in with rotation of the disc 20. In other weapons, the same considerations generally apply with the sight, 1, 10; rotating disc 2, 20; and arm 3, 30 and its mounting holes 39.

Accordingly, when assembled, the sight 10 of the pivoting orbiting sight, moved as the gears 22 and 23 rotate about the gear 24, remains oriented with respect to the axes 11H, 11V. As less desirable alternatives, the sight 10 may pivot without the employment of gears or the like by the simple expedient of having it be freely swingable on the post 19 while having it be weighted akin to a plumb bob so that it remains fixed with the vertical axis 11V by operation of the force of gravity; or the sight 10 may be oriented with respect to a fixed axis through employment of sensors and electric servo-motors, and so forth and the like.

Distance-identifying indicia 40 may be provided on the disc 20 and/or arm 30 such as by etching and/or by inscribing with a pencil. The latter is particularly effective when the pulling weight of a drawstring and weight of arrows are taken in account.

The pivoting orbiting sight of the invention has proven itself to be highly successful in competition and in the field.

CONCLUSION

The present invention is thus provided. Various features, parts, subcombinations and combinations can be employed with or without reference to other features, parts, subcombinations or combinations in the practice of the invention, and numerous and sundry adaptations and modifications can be effected within its spirit, the literal claim scope of which is particularly pointed out as follows:

We claim:

1. An orbiting sight comprising a rotatable sight-mounting member; and, attached in a pivoting relationship to said member, a sighting unit, the attachment being such that, through means for stopping rotation of the sight-mounting member and pivoting of the sighting unit, which excludes having the sighting unit freely swingable to remain in position by force of gravity, the sighting unit can remain positioned in a fixed orientation in relation to an intended shooter-to-target axis when the sight-mounting member is rotated.

2. The sight of claim 1, wherein the means for stopping rotation and pivoting includes gearing.

3. The sight of claim 2, wherein the sighting unit includes a light-gathering fiber sighting pin.

4. In combination, the sight of claim 3, attached to an archery bow.

5. The sight of claim 3, wherein the sighting unit is of the scope type.

6. In combination, the sight of claim 5, attached to an archery bow.

7. The sight of claim 5, wherein the sighting unit is a generally ovoid type.

8. In combination, the sight of claim 7, attached to an archery bow.

9. The sight of claim 7, wherein the sighting unit is mounted to have its major axis vertical with respect to the ground when the orbiting sight is attached to a suitable projectile-type weapon, and an elongate sighting pin is present within the scope and is vertically oriented with respect to the ground when the orbiting sight is attached to a suitable projectile-type weapon.

10. In combination, the sight of claim 9, attached to an archery bow.

11. The sight of claim 2, wherein the gearing is internal gearing.

12. In combination, the sight of claim 11, attached to an archery bow.

13. In combination, the sight of claim 2, attached to an archery bow.

14. In combination, the sight of claim 1, attached to an archery bow.

15. In combination, a projectile—type weapon other than an archery bow, and an orbiting sight comprising a rotatable sight mounting member having a sighting unit attached thereto, wherein, through means for stopping rotation of the sight-mounting member and pivoting of the sighting unit, which excludes having the sighting unit freely swingable to remain in position by force of gravity, the sighting unit can remain positioned in a fixed orientation in relation to an intended shooter-to-target axis when said member is rotated, or is rotated through part of an orbit owing to interference of the sighting unit with said weapon.

16. The combination of claim 15, wherein at least one of the following limitations is present: the sighting unit is of the scope type; the means for stopping rotation and pivoting includes gearing; and the weapon has a shoulder stock.

17. An orbiting sight comprising:

a rotatable sight-mounting member, which includes
- a rotating disc housing having a hollow space for receiving gears, and
- an odd-numbered plurality of gears within the hollow space; and a mounting arm to which the sight-mounting member is rotatably attached; and a sighting unit attached in pivoting relationship to the sight-mounting member, the attachment being such that the sighting unit can remain positioned in a fixed orientation in relation to an intended shooter-to-target axis when the sight-mounting member is rotated.

18. The sight of claim 17, wherein the plurality of gears have teeth, are three in number, and cooperate as a central gear; a middle gear; and a sight-mounting outside gear.

19. The sight of claim 18, wherein at least one of the following limitations is present:

the three gears are planetary gears;

the disc housing comes in two parts, an inner disc and an outer disc; and distance-identifying indicia is provided on at least one of the rotating disc housing, and the mounting arm.

* * * * *